US007395929B2

(12) United States Patent
Keffeler et al.

(10) Patent No.: US 7,395,929 B2
(45) Date of Patent: Jul. 8, 2008

(54) COVER ASSEMBLY FOR A MEDICATION DISPENSER

(76) Inventors: Mark G. Keffeler, 21509 Ridgewood Rd., Elkhorn, NE (US) 68022; David P. Keffeler, 6606 N. 144th St., Omaha, NE (US) 68116

( * ) Notice: Subject to any disclaimer, the term of this patent is extended or adjusted under 35 U.S.C. 154(b) by 434 days.

(21) Appl. No.: 11/130,587

(22) Filed: May 17, 2005

(65) Prior Publication Data

US 2006/0102513 A1 May 18, 2006

Related U.S. Application Data

(63) Continuation-in-part of application No. 10/197,949, filed on Jul. 17, 2002, now Pat. No. 7,097,037.

(51) Int. Cl.
*B65D 83/04* (2006.01)
*B65D 41/32* (2006.01)

(52) U.S. Cl. ..... 206/532; 206/528; 206/538; 220/266

(58) Field of Classification Search ..... 206/528–540; 220/266, 839, 265, 269, 270, DIG. 34
See application file for complete search history.

(56) References Cited

U.S. PATENT DOCUMENTS

| | | | | |
|---|---|---|---|---|
| 4,372,445 | A * | 2/1983 | Keffeler | 206/532 |
| 5,011,018 | A * | 4/1991 | Keffeler | 206/532 |
| 5,328,046 | A * | 7/1994 | Kutz et al. | 220/266 |
| 7,097,037 | B1 * | 8/2006 | Keffeler et al. | 206/532 |

* cited by examiner

*Primary Examiner*—J. Gregory Pickett
(74) *Attorney, Agent, or Firm*—Thomte Patent Law Office; Dennis L. Thomte

(57) ABSTRACT

The present invention is a cover assembly including a cover for covering at least one compartment of a medication dispenser. The cover includes an inner and outer end portion. A locking tab is formed in the inner end wall of the cover for being received in a slot formed in the medication dispenser for securing the cover to the medication dispenser. The locking tab includes a weakened portion for allowing the cover to be fractured and separated from the locking tab as the outer end potion is lifted away from the medication dispenser during removal of the cover. The weakened portion fractures before the outer end portion of the cover is lifted a distance from the medication dispenser less than or equal to a minimum dimension of a pill for preventing removal of the pill from the at least one compartment without removal of the cover from the compartment.

11 Claims, 11 Drawing Sheets

COVER ASSEMBLY FOR A MEDICATION DISPENSER

CROSS-REFERENCE TO RELATED DOCUMENTS

The present application is a continuation-in-part under 35 U.S.C. § 120 of U.S. Application Ser. No. 10/197,949, filed on Jul. 17, 2002 which is herein incorporated by reference in its entirety (now U.S. Pat. No. 7,097,037).

FIELD OF THE INVENTION

The present invention relates generally to the field of medication dispensers and more particularly to a multiple unit container including several dose compartments each compartment covered with a cover including a fracturable tab with a system for preventing medication tampering.

BACKGROUND OF THE INVENTION

United States Pharmacopoeia Xix defines a unit-dose container as a single-unit container so designed that the contents are administered to the patient as a single dose, direct from the container. A single-unit container is defined as one that is closed in such a manner than none of the contents may be removed without obvious destruction of the closure, the contents of which are intended for use promptly after it is opened. Accordingly, each compartment of a single-unit container must meet the above definitions in order to be used in compliance with current federal regulations.

One type of unit-dose container which is currently available permits a pharmacist to place the unit dosages in the individual compartments and to seal the same therein (such containers are commonly referred to in the market as punch cards or bingo cards). A nurse simply breaks the seal on the individual pocket when the dosage is to be administered. Although this packaging has been generally successful, the removal of medication from an individual compartment requires potentially destructive pressure to be exerted against the medication in order to force the medication through the perforated seal on the opposite side of the compartment. Further, the required pressure to be exerted by a healthcare professional for medication dispensement may over time contribute to such professional developing various adverse health conditions such as carpal tunnel syndrome. Furthermore, the slits in the compartment seals may permit the undetected removal of certain forms of medication and finally, the outer shell of that container requires a paper seal or other adhesive means to prevent removal of the entire compartment containing insert therefrom.

An additional form of unit-dose container disclosed in the prior art is one in which the cover assembly for the individual compartments is simply frictionally held in place with no positive locking of the covers onto the compartments. Such design is unsatisfactory for it does not prevent the undetected removal of medication for medication may be removed and the cover replaced without detection.

The assignee of the instant invention has previously patented many types of cover assemblies for medication dispensers including a plurality of individual covers connected together by fracturable links. Each of the compartment covers includes an integral fracturable tab designed to be independently snap-fitted onto the container to hold the lines in place and to provide a secure and tamperproof closure of each compartment. In some of the fracturable links, the separation of the link from the remainder of the cover was enhanced by the utilization of a notch formed in the tab positioned adjacent the juncture of the tab to the cover top plate. For example, see U.S. Pat. Nos. 4,372,445; 4,735,318; 4,741,441; and 5,011,018.

Although the tabs of the earlier patents identified hereinabove did fracture in a satisfactory manner, there is a perception in the field that the covers of the prior art may be slightly raised, without fracturing the tab, so that medication may be removed from the compartment and then replaced in the compartment without detection. Further, there is the perception in the field that a cover may be removed from its compartment by fracturing the tab thereon with the cover then being able to be replaced on its compartment without the fracturing being visible. For example, if medication is returned to a pharmacy, the pharmacy must check each individual cover to ascertain if the cover has been fractured since the same is not readily perceptible or the medication must be discarded as a safety precaution.

Although Applicants believe that the aforementioned perception is in error, Applicants present invention is directed to address and correct such perception. Further, plastic manufacturers continue to modify the plastic used for constructing the covers. For example, polymer manufacturers have developed polymers which yield more flexible covers which are more difficult to fracture. For example, users are required to exert more pressure in order to fracture the cover. Consequently, such modifications require the lids to be re-designed in order to allow for tolerance in the plastic and to minimize the amount of pressure that a user must exert in order to fracture the cover.

Therefore, it would be desirable to configure a unit-dose container which was designed to positively prevent medication tampering.

SUMMARY OF THE INVENTION

Accordingly, the present invention is directed to a cover assembly for a medication dispenser to prevent the undetected removal of medication. In an embodiment, the cover assembly includes a cover for covering at least one compartment of the medication dispenser. The cover includes an inner end portion and an outer end portion. Further, a locking tab is formed in the inner end wall of the cover for being received in a slot formed in the medication dispenser for securing the cover to the medication dispenser. The locking tab may include a weakened portion for allowing the cover to be fractured and separated from the locking tab as the outer end potion is lifted away from the medication dispenser during removal of the cover. In an exemplary embodiment, the weakened portion fractures before the outer end portion of the cover is lifted a distance from the medication dispenser less than or equal to the minimum dimension of the pill for preventing removal of the pill from the at least one compartment without removal of the cover from the compartment.

In specific embodiments of the instant invention, the cover assembly is generally transparent and the inner end portion adjacent to the weakened area becomes opaque upon fracture of the weakened portion for indicating that the weakened portion has been fractured allowing removal of the cover. Further, the inner end portion adjacent to the weakened portion becomes opaque due to the formation of crazes within the inner end portion adjacent to the weakened portion prior to fracturing of the tab from the cover. In such embodiment, the cover is formed of an amorphous polymer. In further embodiments, the inner end portion adjacent to the weakened portion becomes opaque before the outer end portion is lifted a maximum distance of approximately seventy-nine thousandths of an inch (0.079 inch). In an alternative embodiment, the inner end portion adjacent to the weakened portion becomes opaque before the outer end portion is lifted a maximum distance of approximately sixty thousandths of an inch (0.060 inch). In even further exemplary embodiments, the weakened portion fractures before the outer end portion is lifted a maximum distance of approximately seventy-nine thousandths of an inch (0.079 inch) or approximately sixty thousandths of an inch (0.060 inch). Additionally, the weakened portion is defined by a pair of V-shaped notches extending inwardly into the sides of the locking tab. Moreover, a protrusion extending from at least one of the locking tab and the inner end portion of the cover may be included for pivotally engaging with the dispenser as the outer end portion of the cover is lifted for facilitating fracture of the weakened portion.

In accordance with an additional aspect of the present invention, a medication dispenser is provided. In an exemplary embodiment, the medication dispenser includes a container and a multi-compartment removable liner disposed within the container, the liner including a plurality of open-topped compartments. Each compartment within the multi-compartment removable liner holds one or more pills whereby pills placed within the compartments are maintained out of direct contact with the container. Further, the pills have a minimum dimension. In addition, a plurality of covers assemblies for covering respective ones of the compartments are included. Each of the cover assemblies includes a cover for covering the compartment. In the present embodiment, each cover includes an inner end portion and an outer end portion. In further embodiments of the cover assembly, a locking tab formed in the inner end portion of the cover is included for being received in a slot formed in the medication dispenser for securing the cover to the medication dispenser to cover the compartment. The locking tab may include a weakened portion that fractures for allowing the cover to be separated from the locking tab as the outer end portion is lifted away from the medication dispenser during removal of the cover from the compartment. Moreover, the weakened portion fractures before the outer end portion of the cover is lifted a distance from the medication dispenser less than or equal to the minimum dimension of the pills for preventing removal of a pill from the compartment without removal of the cover.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
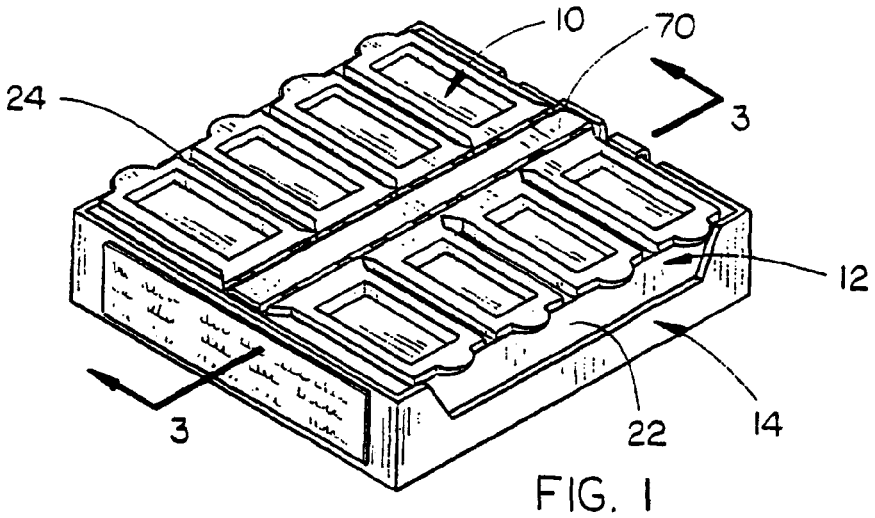
FIG. 1 is an isometric view illustrating a portable medication dispenser in accordance with an exemplary embodiment of the present invention, wherein the medication dispenser includes a cover assembly.
Figure 2:
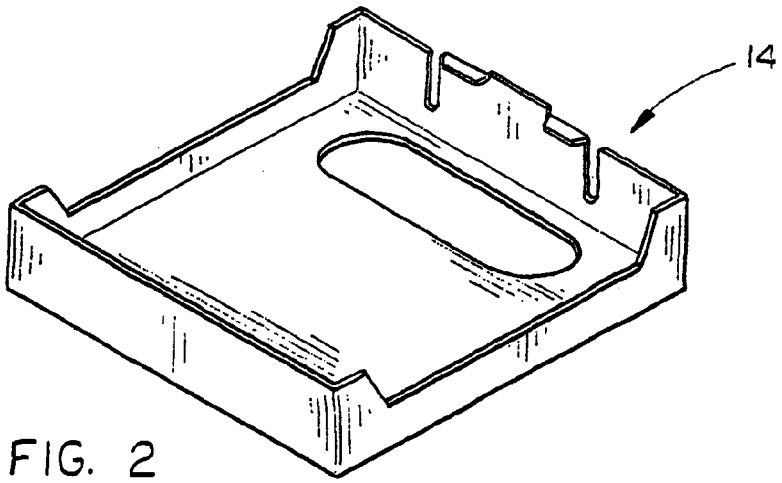
FIG. 2 is an isometric view of the carrier illustrated in FIG. 1.

Reference will now be made in detail to the presently preferred embodiments of the invention, examples of which are illustrated in the accompanying drawings.

Referring specifically to FIGS. 1 through 4, a medication dispenser or container 12 in accordance with an exemplary embodiment of the present invention is illustrated whereby a cover assembly 10 is mounted on a medication dispenser 12 positioned in a carrier 14. The details of the medication dispenser 12 and carrier 14 are disclosed in U.S. Pat. No. 5,735,406. The medication container or dispenser 12 includes a bottom wall 16, upstanding side walls 18 and 20, and upstanding end walls 22 and 24. In one embodiment, a liner 26 is provided in the dispenser 12 to define a plurality of compartments 28, each of which are removably sealed by a cover 30 of the cover assembly 10.

Figure 3:
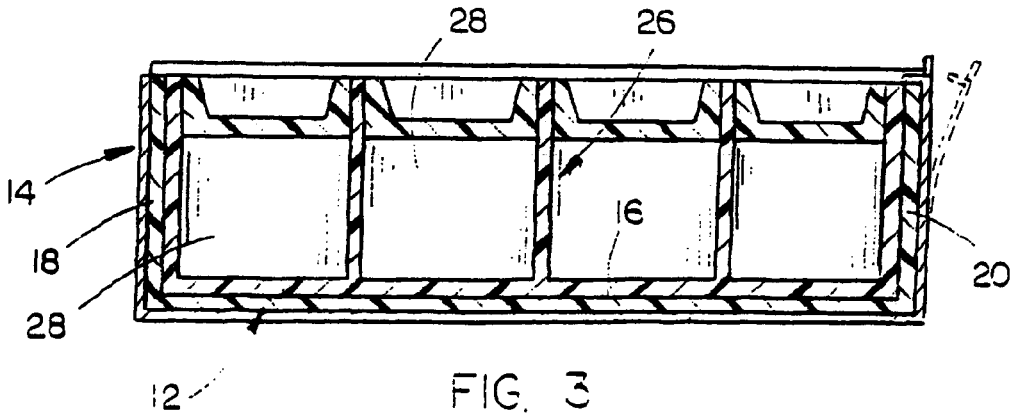
FIG. 3 is a sectional view as illustrated on lines 3-3 of FIG. 1.
Figure 4:
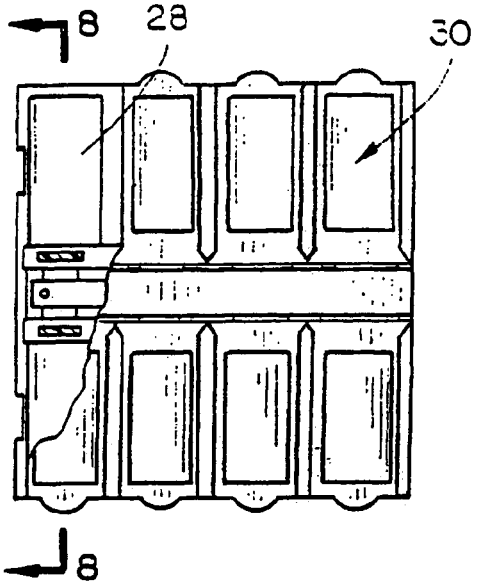
FIG. 4 is a top plan view of the medication dispenser illustrated in FIG. 1, wherein portions of the cover are removed to more fully illustrate the instant invention.

As illustrated in FIGS. 3 and 4, the unitary cover assembly 10 includes a sufficient number of individual compartment covers 30 for closing all of the compartments 28 of one liner 26. In one exemplary embodiment, the cover assembly is unitary as shown in FIGS. 3 and 4. In an additional embodiment, an individual cover 30 will be positioned over the upper end of each compartment 28. It is preferred that the cover assembly 10 be unitary allowing for efficient attachment of the cover assembly 10 to the liner 26.

Figure 5:
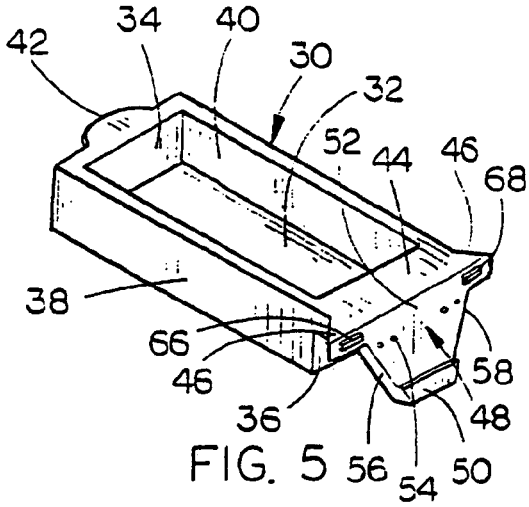
FIG. 5 is an exploded view of an individual cover.

Referring now to FIG. 5, an exemplary embodiment of a cover 30 is provided. In the exemplary embodiment, each cover 30 is generally trough-shaped and includes a generally horizontally extended bottom 32 and opposite end walls, outer end wall 34 and inner end wall 36 and opposite side walls 38 and 40 extending upwardly therefrom. A semi-circular extension 42 at the top edge of the outer end wall 34 facilitates lifting the cover 30 to open a compartment 28. At the top of the inner end wall 36, an integral flange 44 extends generally horizontally away from the end wall 36 and flares outwardly to form fracturable links 46 for interconnecting a plurality of covers 30 so that they may be handled as an integral assembly 10.

Figure 6:
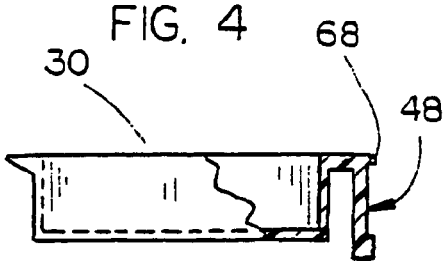
FIG. 6 is a side view of the cover illustrated in FIG. 5 with portions thereof cut away to more fully illustrate the invention.
Figure 7A:
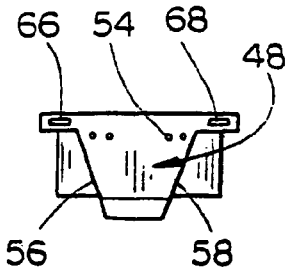
FIG. 7A is an end view of a cover in accordance with the present invention, wherein the cover includes a locking tab with a pair of openings.

An advantageous feature of each compartment cover 30 is the locking tab 48 which functions to independently secure each compartment cover 30 to container 12. In an exemplary embodiment, as illustrated in FIGS. 5, 6, and 7A each tab 48 is a generally flat, downwardly tapering member arranged parallel to the inner end wall 36. The spacing between the tab 48 and the inner end wall 36 is just sufficient for receiving a container divider wall and a liner end wall between them. Each tab 48 is further provided with an upwardly facing shoulder 50 on the interior side thereof and a weakened upper portion 52 formed by a plurality of openings 54 which extend through tab 48 adjacent the juncture of the tab to flange 44. Although it is preferred that a pair of the openings 54 be provided adjacent each of the side edges 56 and 58 of the tab 48, it may be that additional openings 54 will be required in some situations and that they be positioned continuously across the tab 48.

Figure 7B:
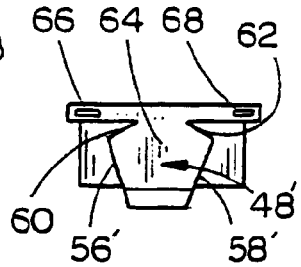
FIG. 7B is an end view of a cover in accordance with the present invention, wherein the cover includes a locking tab with a pair of V-shaped notches.

FIG. 7B illustrates an additional exemplary embodiment of a locking tab 48' in accordance with the present invention. Tab 48' does not include the openings 54 as illustrated in FIGS. 5, 6, and 7A, but is provided with a pair of V-shaped notches 60 and 62 which extend inwardly into the sides of the tab 48' to form a weakened area referred to generally by the reference numeral 64.

FIGS. 5, 6, 7A, 7B, and 8 illustrate structure on the tab 48 or 48' which may be used with either the tabs 48 or 48'. In an exemplary embodiment, a pair of protrusions 66 and 68 extend from the tab 48 or 48' for engagement with the top wall 70 of the container 12. In the present embodiment, the protrusions 66 and 68 act as pivot points against top wall 70 as the cover 30 is moved upwardly thereby enhancing the fracturing of the tab 48 or 48' so that the cover 30 may be separated from the container 12.

Figure 8:
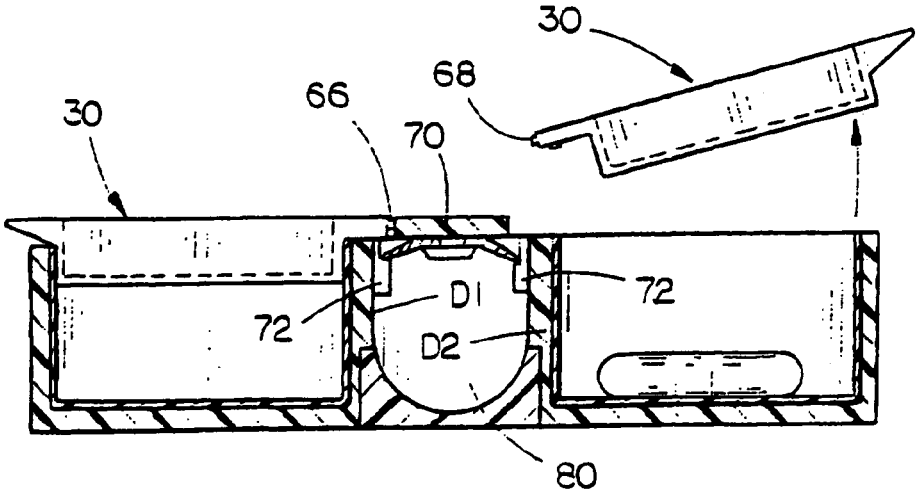
FIG. 8 is a cross sectional view of a medication dispenser in accordance with the present invention, wherein a cover is being removed from the dispenser.
Figure 9:
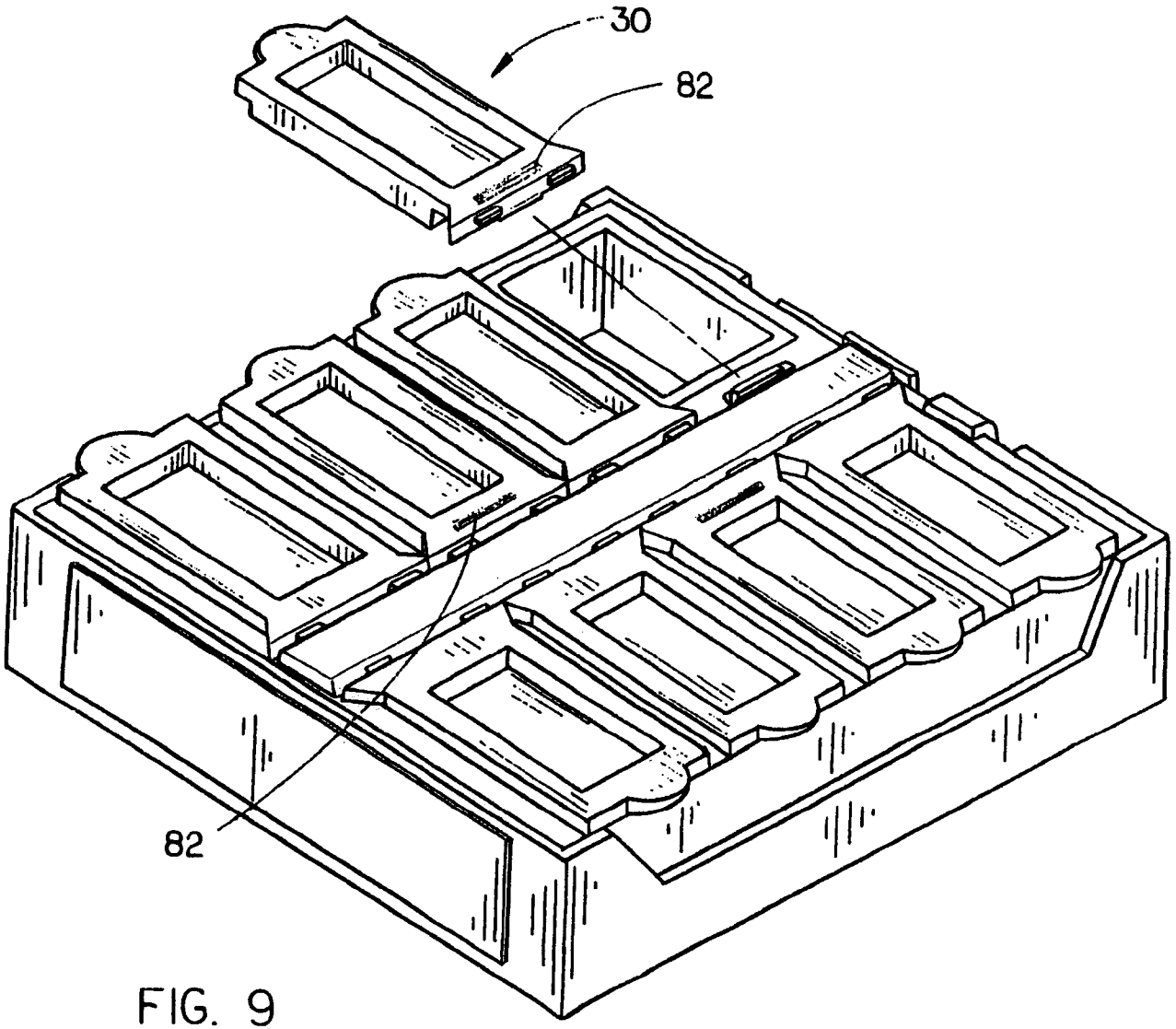
FIG. 9 is an isometric view of a medication dispenser in accordance with the present invention, wherein an individual cover is being removed from the dispenser.

As best illustrated in FIG. 8, the top wall 70 of container 12 extends between and is connected to the upper edges of both divider walls D1 and D2. The top wall 70 cooperates with the divider walls D1 and D2 to define a plurality of elongated spaced apart openings 72 for receiving the tabs 48 of the compartment covers 30. For example, when the cover assembly 10 is positioned on the upper end of compartment liner 26, the tabs 48 on each of the covers 30 are received in the openings 72. At the same time that the covers 30 are depressed into the individual compartments 28 of the liner 26, the trough-shaped covers 30 close and seal each of the open-top compartments 28. The outwardly protruding semi-circular extension 42 at the outer end of each cover 30 engages the outer side wall of the liner, as shown in the drawings, to positively seat the cover onto and within the liner compartment 26.

During an exemplary use, when a compartment is to be opened, the outer end of a cover 30 is pivotally moved upwardly which results in a fracture of the tab 48 at the weakened portion 52 formed by the openings 54 or at the weakened portion 64 formed by the notches 60 and 62 with that fracturing being enhanced by the engagement of the protrusions 66 and 68 with the top wall 70 of the container. The fracturable links 46 connecting that cover to adjacent covers are similarly fractured. The openings 54 or the notches 60 and 62 permit the cover 30 to be easily fractured from the lower end of the link 46 in a clean and neat fashion or manner. That portion of the tab 48 which is positioned below the openings 54 or the notches 60, 62 remains in position until a new locking tab 48 is inserted into the opening 72 causing the residual tab to fall into the trough-shaped cavity 80.

Figure 10:
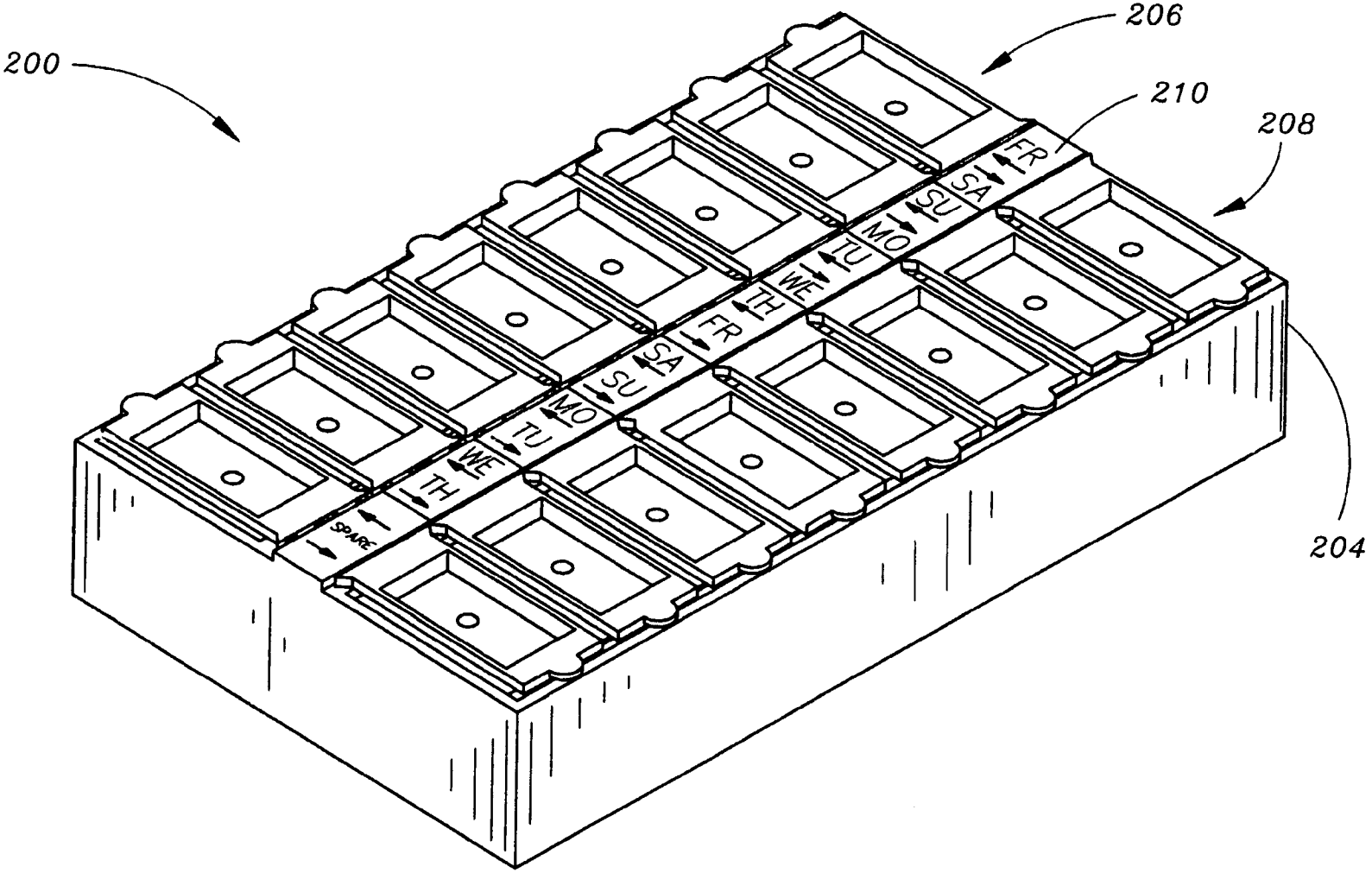
FIG. 10 is an isometric view illustrating a portable medication dispenser in accordance with an additional exemplary embodiment of the present invention, wherein the medication dispenser is designed to contain a two-week supply of one type of medication.
Figure 11:
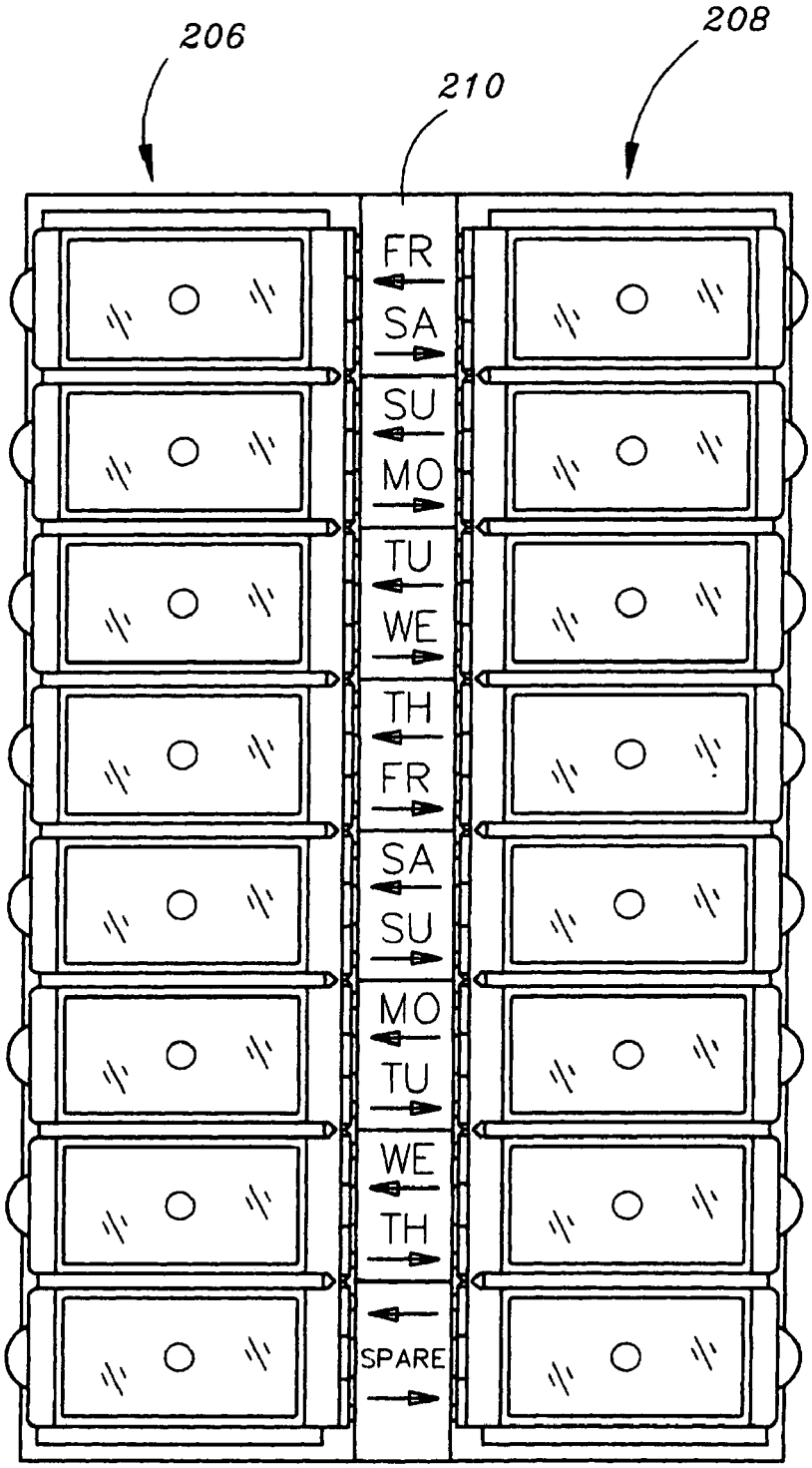
FIG. 11 a top plan view of the portable medication dispenser illustrated in FIG. 10.
Figure 12:
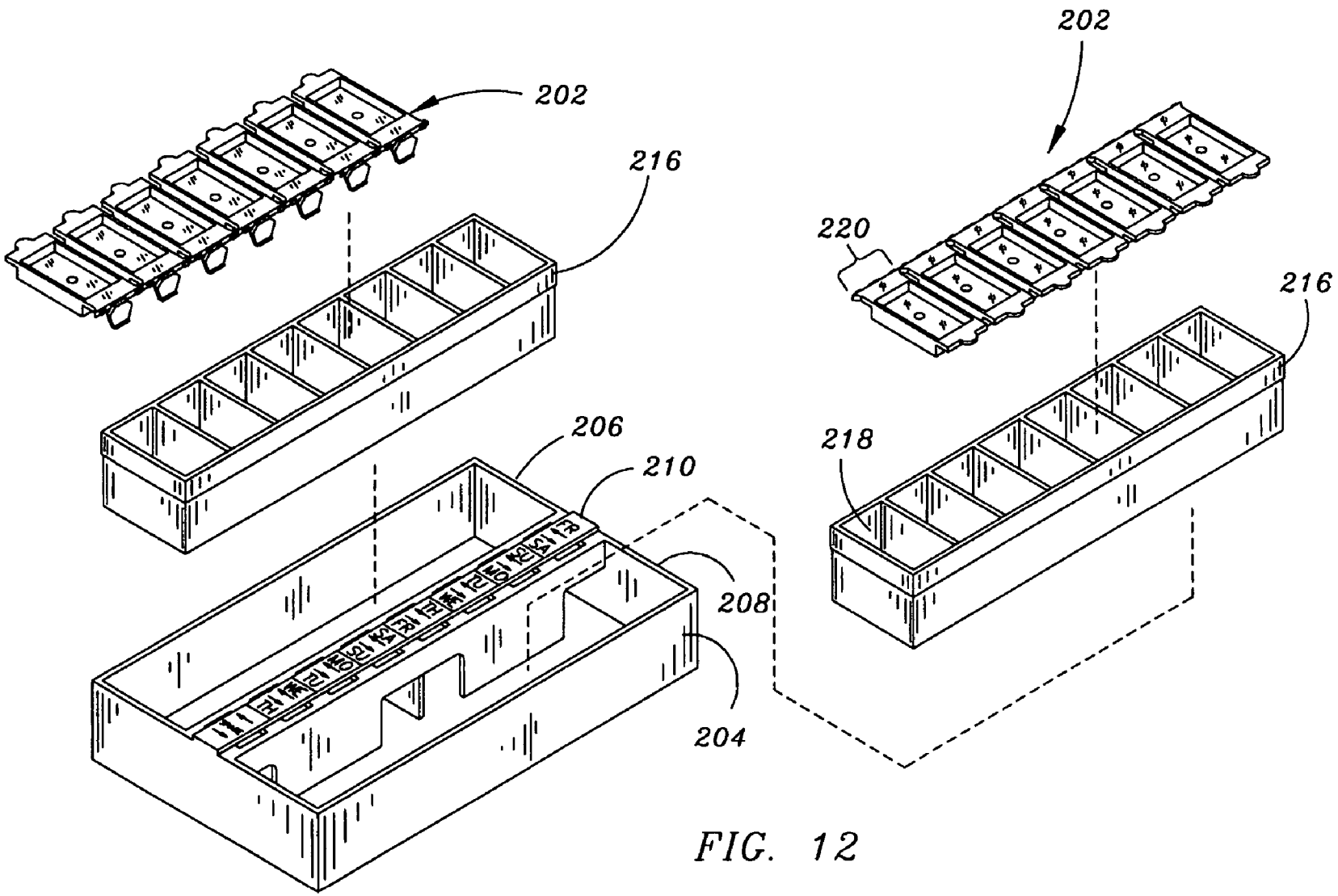
FIG. 12 is an exploded view of the portable medication dispenser illustrated in FIG. 10, wherein the various components of such dispenser are provided.
Figure 13:
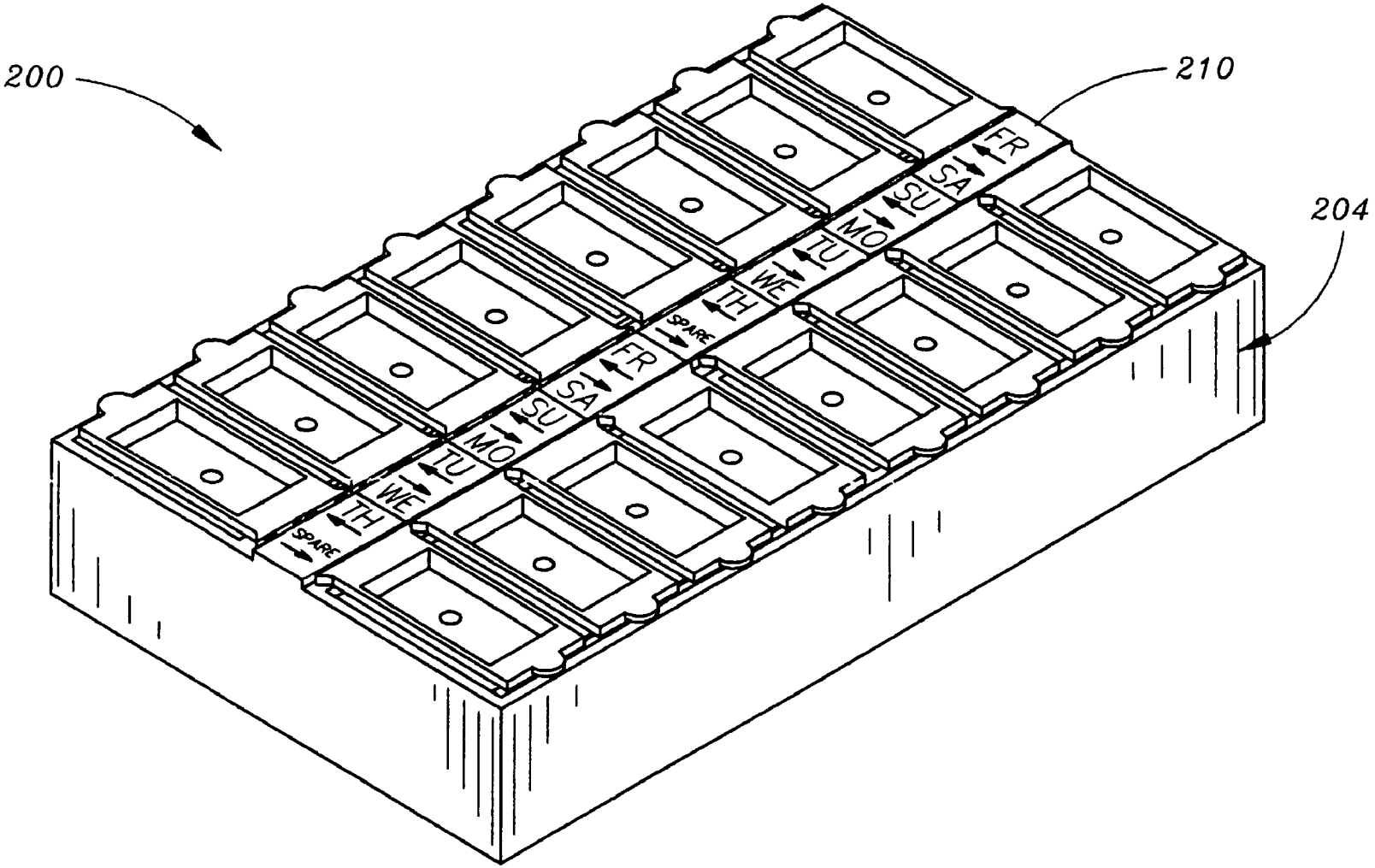
FIG. 13 is an isometric view illustrating a portable medication dispenser in accordance with an additional exemplary embodiment of the present invention, wherein the medication dispenser is designed to contain a one-week supply of two different types of medication.
Figure 14:
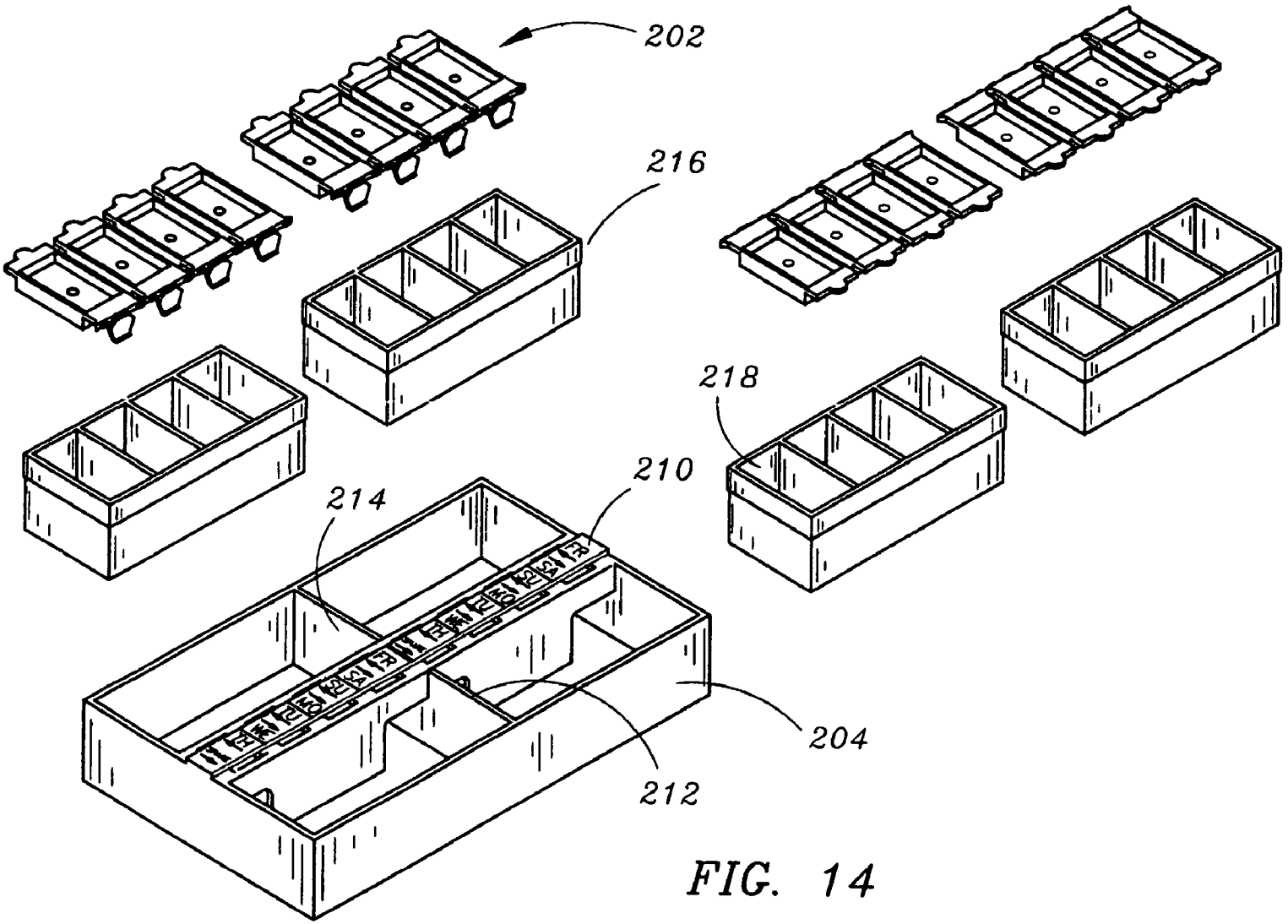
FIG. 14 is an exploded view of a portable medication dispenser illustrated in FIG. 13, wherein the various components of such dispenser are provided.
Figure 17:
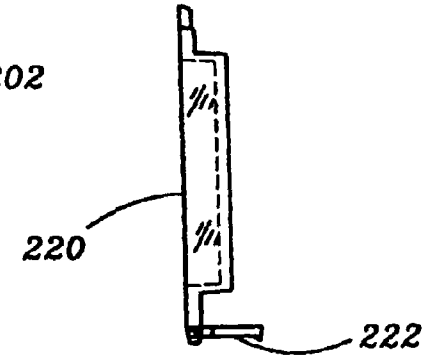
FIG. 17 is a side view of an individual cover assembly.

Referring now to FIGS. 10 through 24, a further exemplary embodiment of a portable medication dispenser 200 in accordance with the present invention is illustrated. The dispenser 200 includes a unitary cover assembly 202 designed to prevent the undetected removal of medication. In various embodiments, the portable medication dispenser 200 may be designed to dispense a two-week supply of medication (FIGS. 10, 11, and 12) or two different one-week supplies of medication (FIGS. 13 and 14). In FIGS. 10, 11, and 12 the medication dispenser 200 includes a container frame 204 which is divided into two sections 206 and 208. In the embodiment, an inner wall 210 is labeled with the days of the week or the word "spare."

It is contemplated that various labeling schemes may be employed without departing from the scope and spirit of the present invention. For example, compartments may be denoted for time of dosage. In the present embodiment, a two-week supply of medication is provided. As further illustrated in FIG. 12, a medication dispenser unit is assembled by placing liners 216 in section 206 and section 208 of the container 204. The unitary cover assembly 202 is then placed in alignment with the individual compartments 218 contained within the liner 216 so that each compartment 218 is covered with a cover 220 except for the compartment labeled as "spare." If one desires to provide a "spare" dosage of medication, an individual cover 220 may be placed over the individual compartment 218.

In an alterative embodiment, as illustrated in FIGS. 13 and 14, the container frame 204 is divided into quadrants defined by inner wall 210 and walls 212 and 214 allowing the medication dispenser 200 to include two, one-week supplies of each type of medication. As illustrated in FIG. 14, the medication dispenser unit 200 is assembled by placing a total of four liners 216 into the container frame 204, one into each quadrant defined by the inner wall 210 and walls 212 and 214. The unitary cover assembly 202 is then placed in alignment with the individual compartments 218 contained within each liner 216 so that each compartment 218 is covered with a cover 220. It is contemplated that the number of compartments as well as the labeling may vary depending upon user need. For example, the coloring of the container frame 204 may vary depending upon time of dosage, type of medication regime, and the like.

Figure 15:
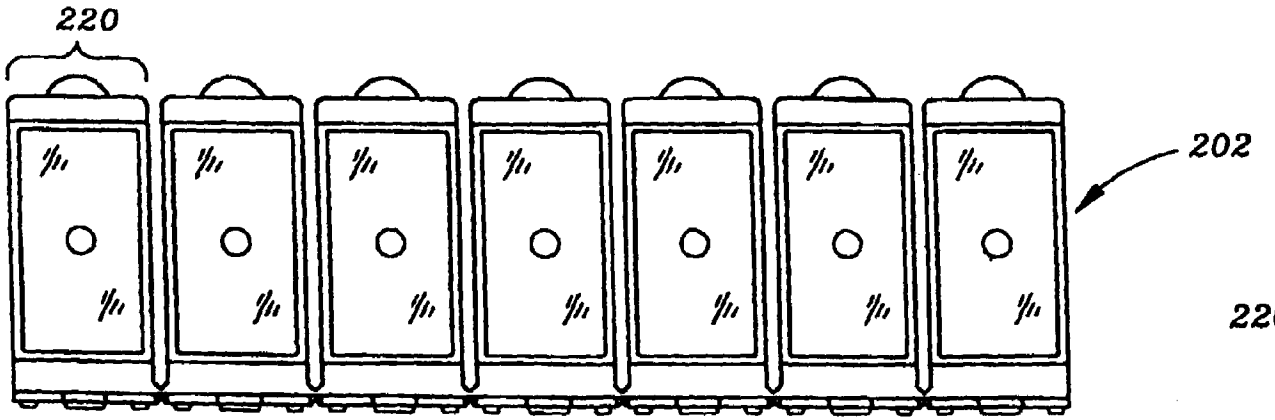
FIG. 15 is a top plan view of an exemplary cover assembly for a portable medication dispenser, wherein the cover assembly is unitary.
Figure 16:
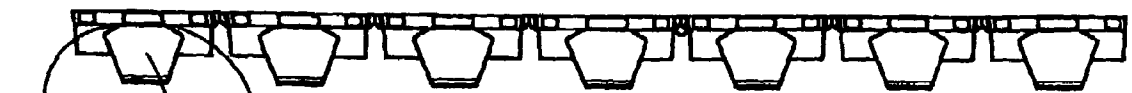
FIG. 16 is an end view of the cover assembly illustrated in FIG. 15, wherein each cover includes a locking tab with a pair of V-shaped notches.

Referring now to FIGS. 15 and 16, an exemplary embodiment of the cover assembly 202 is provided wherein the cover assembly 202 is unitary. In the exemplary embodiment, the unitary cover assembly 202 includes a sufficient number of individual compartment covers 220 for closing all of the compartments 218 of one liner 216 except for the compartment labeled "spare." Although the cover assembly 202 is illustrated as being unitary, it is contemplated that in additional embodiments individual covers 220 may be positioned over the upper end of each compartment 218 as is done traditionally only for the "spare" compartment. Utilizing a cover assembly 202 which is unitary allows for efficient attachment of the cover assembly 202 to the liner 216.

In the exemplary embodiment, as illustrated in FIGS. 16 through 20, each compartment cover 220 includes a locking tab 222 which functions to independently secure each compartment cover 220 to the container frame 204. In the embodiment, each tab 222 is generally flat, includes six sides, and arranged parallel to the inner wall 210. Further, in the present embodiment, each tab 222 includes a pair of V-shaped notches 224 and 226 which extend inwardly into the sides of the tab 222 to form a weakened area referred to generally by the reference numeral 222. The spacing between the tab 222 and the inner wall 210 is just sufficient for receiving a container frame 204 divider wall and a liner 216 end wall between them.

Figure 18:
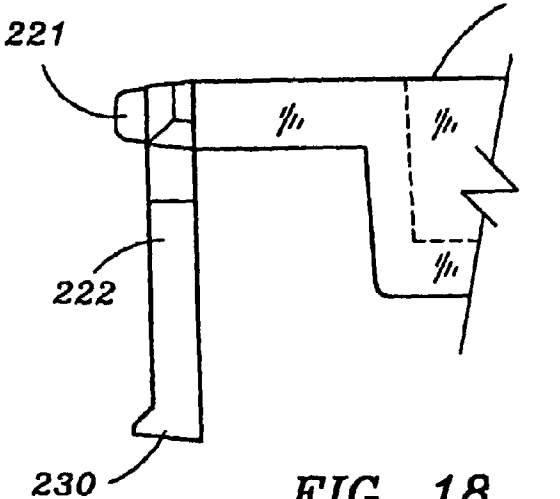
FIG. 18 is an exploded view of the individual cover assembly illustrated in FIG. 17.
Figure 19:
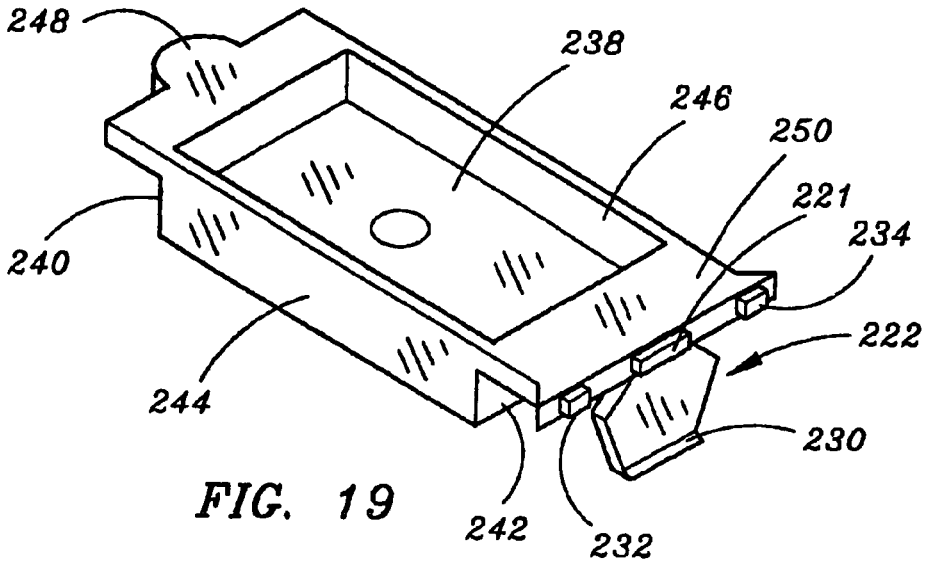
FIG. 19 is an exploded view of an individual cover assembly, wherein the locking tab is attached.
Figure 20:
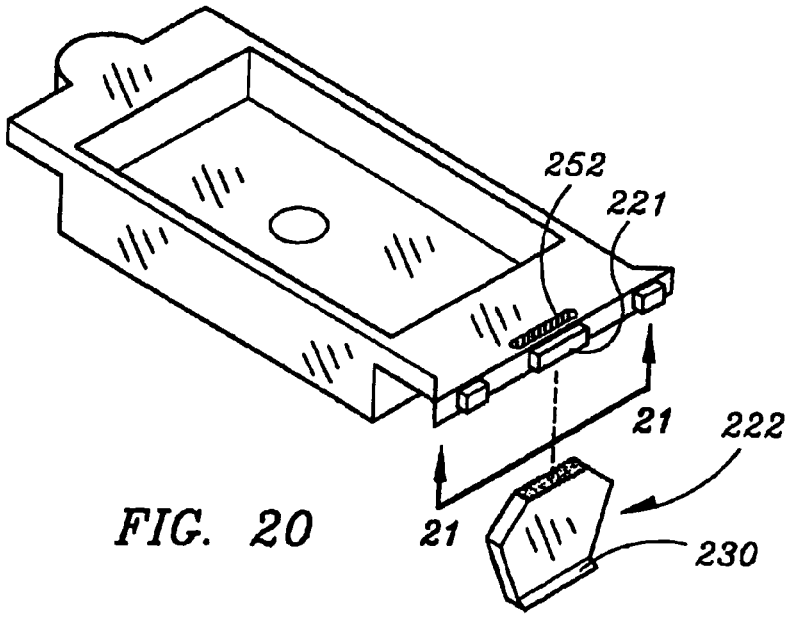
FIG. 20 is an exploded view of an individual cover assembly, wherein the locking tab has been fractured.
Figure 21:
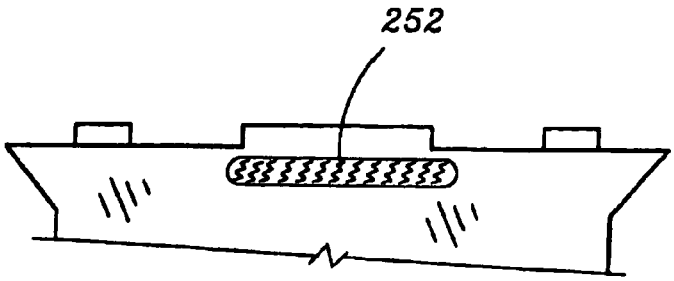
FIG. 21 is a side view of the individual cover assembly illustrated in FIG. 20, wherein crazes are present within the locking tab.
Figure 22:
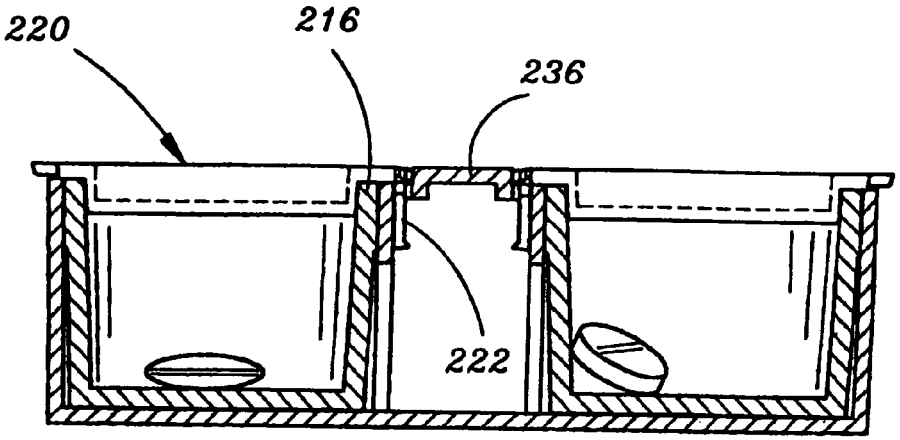
FIG. 22 is a cross-sectional view of a portable medication dispenser in accordance with the present invention, wherein the lock tab is attached to the cover assembly and is transparent.
Figure 23:
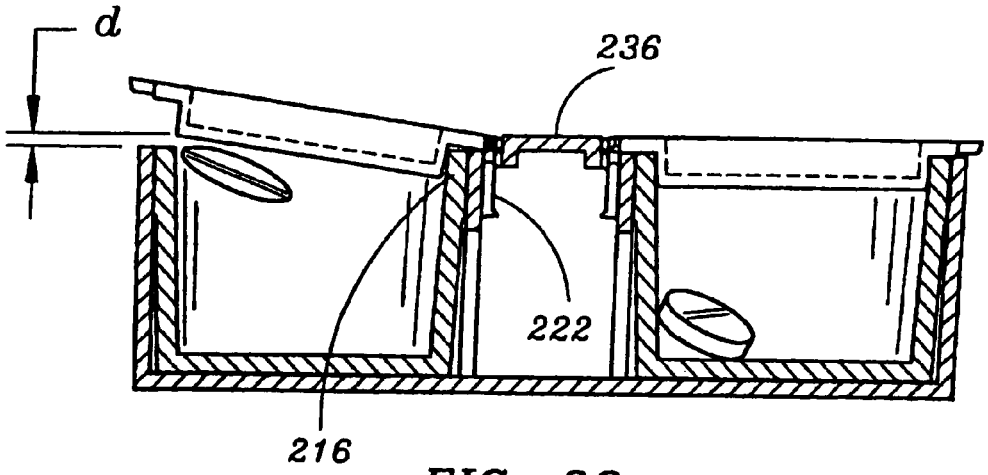
FIG. 23 is a cross-sectional view of a portable medication dispenser in accordance with the present invention, wherein the lifting of the cover distance d causes the lock tab to turn opaque without causing lock tab fractionation.
Figure 24:
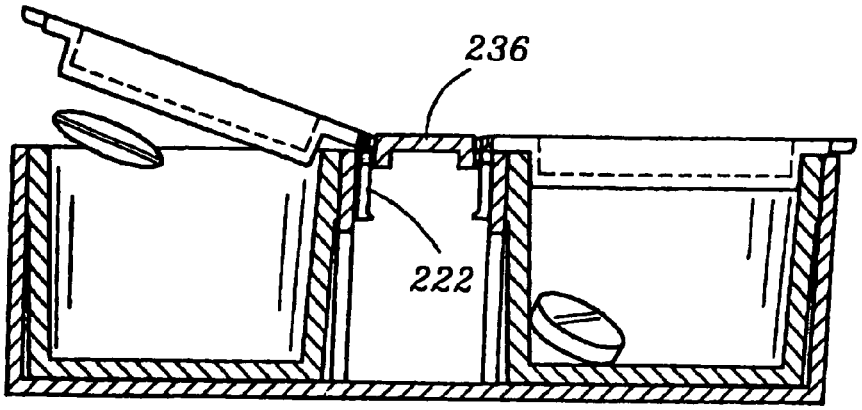
FIG. 24 is a cross-sectional view of a portable medication dispenser in accordance with the present invention, wherein the lock tab is fractured and opaque.

In further exemplary embodiments, as illustrated in FIGS. 18, 19 and 20, each tab 222 may be provided with an upwardly facing shoulder 230 on the interior side thereof. It is contemplated that in additional embodiments, openings which extend through the tab may be included within the body of the tab in order to form a weakened area. In addition, in the exemplary embodiment, a plurality of protrusions 232, 221, and 234 extend from the tab 222 for engagement with a top wall 236 of the container frame 204. In such embodiment, the protrusions 232, 221, and 234 act as pivot points against top wall 236 of the container frame 204 as the cover 220 is moved upwardly thereby enhancing the fracturing of the tab 222 so that the cover 220 may be separated from the container frame 204.

Referring to FIGS. 19 and 20, an exemplary embodiment of the cover 220 is provided. In this embodiment, each cover 220 is generally trough-shaped and includes a generally horizontally extended bottom 238, an outer end wall 240, an inner end wall 242 and opposite side walls 244 and 246 extending upwardly therefrom. A semi-circular extension 248 at the top edge of the outer end wall 240 facilitates lifting the cover 220 to open a compartment. At the top of the inner end wall 244, an integral flange 250 extends generally horizontally away from the inner end wall 242 and flares outwardly to form fracturable links for interconnecting a plurality of covers 220 so that they may be handled as an integral or unitary assembly.

With continued reference to FIGS. 19 and 20, in the exemplary embodiment, the center protrusion 221 is of a greater length than the outer two protrusions 232 and 234. Protrusion 221 not only serves as a pivot point, but allows crazes 252 which form within the locking tab attachment area 252 (e.g. the area appears opaque) when the cover 220 is lifted to be magnified allowing an observer to more easily detect fracturing of a cover 220. For example, the presence of the protrusion 221 allows the crazes 252/opaqueness to be magnified approximately 1.5 to 1.75 times that measured to covers not including the protrusion 221.

Referring now to FIGS. 20 through 24, an exemplary embodiment of the locking tab 222 designed to prevent undetected removal of medication is described. In this embodiment, the cover assembly 202 including the locking tab 222 is formed of a polymer so that upon application of certain levels of strain the transparent locking tab 222 will turn opaque allowing a user to be alerted to such handling. In an exemplary embodiment, the cover assembly 202 is formed of an amorphous polymer for such polymer includes the desired properties (e.g. crazes which cause the substrate to appear as opaque are formed within the bulk of the substrate at certain strain levels).

In an additional exemplary embodiment, the weakened portion of the locking tab 222 fractures and the locking tab attachment area 252 turns opaque before the outer end portion of the cover 220 is lifted a distance from the medication dispenser less than or equal to the minimum dimension of the pill for preventing removal of the pill from the individual compartment. In the embodiment, crazes appear within the locking tab attachment area 252 (e.g. the area appears opaque) when the cover 220 is lifted a specified distance, denoted as d in FIG. 23. For example, for packaging of pills in the smallest dimension (thickness) range of seventy-nine (79) to eight (80) thousandths of an inch (e.g. the smallest known), cover assemblies 202 are designed so that crazes may appear within the locking tab attachment area 252 (the top of the locking tab 222) when the weakened portion 222 of the cover fractures before lifting the outer end portion of the cover 220 to a maximum of approximately seventy-nine (79) thousandths of an inch.

In an alternative embodiment, cover assemblies 202 are designed so that the weakened portion 222 fractures and the locking tab attachment area 252 appears opaque before lifting the outer end of the cover 220 to a maximum of approximately sixty (60) thousandths of an inch. Such embodiment allows for tolerance present within the plastic. It is contemplated that different straining points may be employed without departing from the spirit and scope of the instant invention as specified for different pill sizes. It is further contemplated that the separation may occur with the fracturing of the cover 202 from the medication dispenser 200, but is not required.

In additional embodiments, the fracturing of the cover 220 results in an audible sound such as a "click." Such feature provides an additional way of determining when a cover has been fractured. For example, the fracturing of a newly placed non-fractured cover will result in the generation of an audible clicking sound. If the previously fractured tab were to be placed back onto the cover frame, such activity would be detected by a user for a user would not hear the audible click when removing the previously fractured cover.

In even further exemplary embodiments, the amount of pressure required to be exerted by a user may be utilized to determine cover fracturing. For example, in order to fracture a newly placed non-fractured cover, a user must exert a greater amount of pressure in order to remove the cover when compared to amount of pressure required to remove a previously fractured cover which had been placed back onto the cover frame. Such feature provides an additional manner in which a user may detect cover fracturing.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A cover assembly for a medication dispenser having at least one compartment which is selectively enclosed by the cover assembly for holding a pill, the pill having a minimum dimension, comprising:

a cover for covering the at least one compartment of the medication dispenser, the cover including an inner end portion and an outer end portion;

a locking tab formed in the inner end portion of the cover for being received in a slot formed in the medication dispenser for securing the cover to the medication dispenser to cover the at least one compartment, the locking tab including a weakened portion that fractures for allowing the cover to be separated from the locking tab as the outer end portion is lifted away from the medication dispenser during removal of the cover;

wherein the weakened portion fractures before the outer end portion of the cover is lifted a predetermined distance from the medication dispenser for preventing removal of the pill from the at least one compartment without removal of the cover;

said cover assembly being generally transparent;

said inner end portion adjacent to the weakened area becoming opaque upon the fracture of the weakened portion for indicating that the weakened portion has been fractured allowing removal of the cover;

said inner end portion adjacent to the weakened portion becomes opaque due to the formations of crazes within said inner end portion adjacent to the weakened portion before said outer end portion is lifted a maximum distance of approximately seventy-nine thousandths of an inch (0.079 inch).

2. The cover assembly as claimed in claim 1, wherein the inner end portion adjacent to the weakened portion becomes opaque due to the formation of crazes within the inner end portion adjacent to the weakened portion before the outer end portion is lifted a maximum distance of approximately sixty thousandths of an inch (0.060) inch.

3. A medication dispenser, comprising:

a container;

a multi-compartment removable liner disposed within the container, the liner including a plurality of open-topped compartments, each compartment for holding one or more pills whereby pills whereby pills placed within the compartments are maintained out of direct contact with the container, the pills having a minimum dimension; and a plurality of covers assemblies for covering respective ones of the compartments, each of the cover assemblies including: a cover for covering the compartment, the cover including an inner end portion and an outer end portion;

a locking tab formed in the inner end portion of the cover for being received in a slot formed in the medication dispenser for securing the cover to the medication dispenser to cover the compartment, the locking tab including a weakened portion that fractures for allowing the cover to be separated from the locking tab as the outer end portion is lifted away from the medication dispenser during removal of the cover from the compartment wherein the weakened portion fractures before the outer end portion of the cover is lifted a predetermined distance from the medication dispenser for preventing removal of a pill from the compartment without removal of the cover;

said cover assembly being generally transparent;

said inner end portion adjacent to the weakened area becoming opaque upon fracture of the weakened portion for indicating the weakened portion has been fractured allowing removal of the cover;

said inner end portion adjacent to the weakened portion becoming opaque due to the formation of crazes within said inner end portion adjacent to the weakened portion before the outer end portion is lifted a maximum distance of approximately seventy-nine thousandths of an inch (0.079 inch).

4. A medication dispenser, comprising a container;

a multi-compartment removable liner disposed within the container, the liner including a plurality of open-topped compartments, each compartment for holding one or more pills whereby pills whereby pills placed within the compartments are maintained out of direct contact with the container, the pills having a minimum dimension; and a plurality of covers assemblies for covering respective ones of the compartments, each of the cover assemblies including:

a cover for covering the compartment, the cover including an inner end portion and an outer end portion;

a locking tab formed in the inner end portion of the cover for being received in a slot formed in the medication dispenser for securing the cover to the medication dispenser to cover the compartment, the locking tab including a weakened portion that fractures for allowing the cover to be separated from the locking tab as the outer end portion is lifted away from the medication dispenser during removal of the cover from the compartment wherein the weakened portion fractures before the outer end portion of the cover is lifted a predetermined distance from the medication dispenser for preventing removal of a pill from the compartment without removal of the cover;

said cover assembly being generally transparent;

said inner end portion adjacent to the weakened area becoming opaque upon fracture of the weakened portion for indicating the weakened portion has been fractured allowing removal of the cover;

said inner end portion adjacent to the weakened portion becoming opaque due to the formation of crazes within said inner end portion adjacent to the weakened portion before the outer end portion is lifted a maximum distance of approximately sixty thousandths of an inch (0.060 inch).

5. A cover assembly for a medication dispenser having at least one compartment which is selectively enclosed by the cover assembly for holding a pill, the pill having a minimum dimension, comprising:

a cover for covering at least one compartment of the medication dispenser, the cover including an inner end portion and an outer end portion;

a locking tab formed in the inner end portion of the cover for being received in a slot formed in the medication dispenser for securing the cover to the medication dispenser to cover the at least one compartment, the locking tab including a weakened portion that fractures for allowing the cover to be separated from the locking tab as the outer end portion is lifted away from the medication dispenser during removal of the cover;

wherein the weakened portion fractures before the outer end portion of the cover is lifted a predetermined distance from the medication dispenser for preventing removal of the pill from the at least one compartment without removal of the cover;

said cover assembly being generally transparent;

said inner end portion adjacent to the weakened area becoming opaque upon the fracture of the weakened portion for indicating that the weakened portion has been fractured allowing removal of the cover.

6. The cover assembly as claimed in claim 5, wherein the inner end portion adjacent to the weakened portion becomes opaque due to the formation of crazes within the inner end portion adjacent to the weakened portion prior to fracturing of the tab from the cover.

7. The cover assembly as claimed in claim 5, wherein the cover is formed of an amorphous polymer.

8. The cover assembly as claimed in claim 5, further comprising a protrusion extending from at least one of the locking tab and the inner end portion of the cover, the protrusion pivotally engaging with a dispenser as the outer end portion of the cover is lifted for facilitating fracture of the weakened portion and magnifying the opaque area.

9. A medication dispenser, comprising a container;

a multi-compartment removable liner disposed within the container, the liner including a plurality of open-topped compartments, each compartment for holding one or more pills whereby pills whereby pills placed within the compartments are maintained out of direct contact with the container, the pills having a minimum dimension; and a plurality of covers assemblies for covering respective ones of the compartments, each of the cover assemblies including:

a cover for covering the compartment, the cover including an inner end portion and an outer end portion;

a locking tab formed in the inner end portion of the cover for being received in a slot formed in the medication dispenser for securing the cover to the medication dispenser to cover the compartment, the locking tab including a weakened portion that fractures for allowing the cover to be separated from the locking tab as the outer end portion is lifted away from the medication dispenser during removal of the cover from the compartment.

wherein the weakened portion fractures before the outer end portion of the cover is lifted a predetermined distance from the medication dispenser for preventing removal of a pill from the compartment without removal of the cover;

said cover assembly being generally transparent;

said inner end portion adjacent to the weakened area becoming opaque upon fracture of the weakened portion for indicating the weakened portion has been fractured allowing removal of the cover.

10. The medication dispenser as claimed in claim 9, wherein the inner end portion adjacent to the weakened portion becomes opaque due to the formation of crazes within the inner end portion adjacent to the weakened portion prior to fracturing of the tab from the cover.

11. The medication dispenser as claimed in claim 9, further comprising a protrusion extending from at least one of the locking tab and the inner end portion of the cover, the protrusion pivotally engaging with the dispenser as the outer end portion of the cover is lifted for facilitating fracture of the weakened portion and magnifying the opaque area.

* * * * *